US010939506B2

(12) United States Patent
Jeanneteau et al.

(10) Patent No.: US 10,939,506 B2
(45) Date of Patent: Mar. 2, 2021

(54) METHOD FOR CONTROLLING AN INDUCTION HOB

(71) Applicant: ELECTROLUX APPLIANCES AKTIEBOLAG, Stockholm (SE)

(72) Inventors: Laurent Jeanneteau, Forli (IT); Alex Viroli, Forli (IT); Svend Erik Christiansen, Forli (IT); Massimo Nostro, Forli (IT); Fabio Angeli, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 16/322,339

(22) PCT Filed: Jul. 28, 2017

(86) PCT No.: PCT/EP2017/069224

§ 371 (c)(1),
(2) Date: Jan. 31, 2019

(87) PCT Pub. No.: WO2018/029016

PCT Pub. Date: Feb. 15, 2018

(65) Prior Publication Data

US 2019/0200420 A1 Jun. 27, 2019

(30) Foreign Application Priority Data

Aug. 8, 2016 (EP) ..... 16183254

(51) Int. Cl.
*H05B 6/06* (2006.01)
*H05B 6/44* (2006.01)

(52) U.S. Cl.
CPC ..... *H05B 6/065* (2013.01); *H05B 6/44* (2013.01); *H05B 2213/03* (2013.01)

(58) Field of Classification Search
CPC ..... H05B 2213/07; H05B 6/06; H05B 6/062; H05B 6/065; H05B 6/129
(Continued)

(56) References Cited

U.S. PATENT DOCUMENTS 6,528,770 B1 * 3/2003 Akel ..... H05B 6/04 219/624
2007/0164017 A1 * 7/2007 Gouardo ..... H05B 6/065 219/626

(Continued)

FOREIGN PATENT DOCUMENTS

DE 102004003126 A1 8/2005
EP 2355617 A2 8/2011

(Continued)

OTHER PUBLICATIONS

International Search Report and Written Opinion issued in corresponding PCT application No. PCT/EP2017/069224 dated Oct. 30, 2017, 14 pages.

*Primary Examiner* — Tu B Hoang
*Assistant Examiner* — Vy T Nguyen
(74) *Attorney, Agent, or Firm* — Pearne & Gordon LLP

(57) ABSTRACT

The invention relates to a method for controlling an induction hob (1), the induction hob (1) comprising a plurality of induction coils (3) and two or more power units (4), each power unit (4) being coupled with one or more induction coils (3), wherein a cooking zone is formed by associating one or more induction coils (3) to a coil group (6.1-6.4), the method comprising the steps of: —defining one or more coil groups (6.1-6.4), each coil group (6.1-6.4) being associated with one or more induction coils (3); —calculating a relative power value or relative electrical parameter value of each coil group (6.1-6.4) based on a maximum power value or maximum electrical parameter value, the maximum power value being the power value of the coil group with the (Continued)

highest power request, respectively, the maximum electrical parameter value being an electrical parameter value of the coil group (6.1-6.4) with the highest power request; —calculating, for each coil group (6.1-6.4), a coil activation number based on the relative power value or relative electrical parameter value, the coil activation number being the number of induction coils (3) to be activated in subsequent steps of a coils activation sequence; —establishing a coils activation schedule based on the coil activation number; —operating the induction hob (1) according to the coils activation schedule. wherein the power units (4) are operated according to a master-slave configuration, wherein a master power unit is adapted to calculate the coil activation number, establish the coils activation schedule and operate the plurality of induction coils (3) of a master power unit and one or more slave power units according to the coils activation schedule.

12 Claims, 4 Drawing Sheets

(58) Field of Classification Search
USPC ..... 219/494, 443.1, 448.11, 497, 600
See application file for complete search history.

(56) References Cited

U.S. PATENT DOCUMENTS

| | | | | |
|---|---|---|---|---|
| 2009/0139980 | A1* | 6/2009 | Acero Acero | H05B 6/04 219/489 |
| 2010/0282740 | A1* | 11/2010 | Artigas Maestre | H05B 6/065 219/662 |
| 2011/0168694 | A1* | 7/2011 | Sadakata | H05B 6/062 219/624 |
| 2011/0272397 | A1* | 11/2011 | Artal Lahoz | H05B 6/1272 219/622 |
| 2012/0248095 | A1* | 10/2012 | Lee | H05B 6/1272 219/620 |
| 2012/0255946 | A1* | 10/2012 | Kim | H05B 6/065 219/622 |
| 2016/0157301 | A1* | 6/2016 | Garde Aranda | H05B 6/062 219/622 |

FOREIGN PATENT DOCUMENTS

| | | | | |
|---|---|---|---|---|
| EP | 2731402 | A1 * | 5/2014 | H05B 6/065 |
| EP | 2731402 | A1 | 5/2014 | |
| WO | 2016010492 | A1 | 1/2016 | |

* cited by examiner

FIG 7

| | | Coil group 6.1 | | | | Coil group 6.2 | | Coil group 6.3 | | | | Coil group 6.4 | |
|---|---|---|---|---|---|---|---|---|---|---|---|---|---|
| | | Coil subgroup 6.1.1 | | Coil subgroup 6.1.2 | | | | Coil subgroup 6.3.1 | | Coil subgroup 6.3.2 | | | |
| | Activation step | Coil 1 | Coil 2 | Coil 1 | Coil 2 | Coil 1 | Coil 2 | Coil 1 | Coil 2 | Coil 1 | Coil 2 | Coil 1 | Coil 2 |
| Acivation period | 1 | X | | X | | X | | X | | X | | X | |
| | 2 | | X | | X | | X | | X | | X | | X |
| | 3 | X | | X | | X | | X | | X | | X | |
| | 4 | | X | | X | | X | | X | | X | | X |
| | 5 | X | | X | | X | | X | | X | | X | |
| | 6 | | X | | X | | X | | X | | X | | X |
| | 7 | X | | X | | X | | X | | X | | X | |
| | 8 | | X | | X | | X | | X | | X | | X |
| | 9 | X | | X | | X | | X | | X | | X | |
| | 10 | | X | | X | | X | | X | | X | | X |

METHOD FOR CONTROLLING AN INDUCTION HOB

The present invention relates generally to the field of induction hobs. More specifically, the present invention is related to a method for controlling an induction hob using a coils activation schedule.

BACKGROUND OF THE INVENTION

Induction hobs for preparing food are well known in prior art. Induction hobs typically comprise at least one heating zone which is associated with at least one induction coil. For heating a piece of cookware placed on the heating zone, the induction coil is coupled with electronic driving means, in the following referred to as power unit, for driving an AC current through the induction coil.

Induction hobs are known which comprise a flexible heating zone concept. Multiple induction coils can be merged for forming larger heating zones in order to be able to heat large-sized pieces of cookware.

Adjacent induction coils generate interference between each other if their frequencies are different. This may result in audible noise if the difference between the frequencies is in the audible range. Typically induction coils of the same heating zone are powered by the same frequency. However, adjacent heating zones may be driven at different frequencies in order to obtain different power levels.

SUMMARY OF THE INVENTION

It is an objective of the embodiments of the invention to provide a method for controlling an induction hob which on the one hand avoids the occurrence of acoustic noise, on the other hand ensures a uniform heating of a piece of cookware placed on the induction hob. The objective is solved by the features of the independent claims. Preferred embodiments are given in the dependent claims. If not explicitly indicated otherwise, embodiments of the invention can be freely combined with each other.

According to an aspect, the invention relates to a method for controlling an induction hob. The induction hob comprises a plurality of induction coils and two or more power units. Each power unit is coupled with one or more induction coils. A cooking zone is formed by associating one or more induction coils to a coil group. The method comprises the steps of:

- defining one or more coil groups, each coil group being associated with one or more induction coils;
- calculating a relative power value or relative electrical parameter value of each coil group based on a maximum power value or maximum electrical parameter value, the maximum power value being the power value of the coil group with the highest power request, respectively, the maximum electrical parameter value being an electrical parameter value of the coil group (6.1-6.4) with the highest power request;
- calculating, for each coil group, a coil activation number based on the relative power value or relative electrical parameter value, the coil activation number being the number of induction coils to be activated in subsequent steps of a coils activation sequence;
- establishing a coils activation schedule based on the coil activation number;
- operating the induction hob according to the coils activation schedule.

In addition, the power units are operated according to a master-slave configuration, wherein a master power unit is adapted to calculate the coil activation number, establish the coils activation schedule and operate the plurality of induction coils of a master power unit and one or more slave power units according to the coils activation schedule.

The main advantage of the present invention is that based on the coils activation schedule developed by the master power unit, the induction coils can be controlled such that no or essentially no acoustic noise occurs and a balanced heat distribution within the piece of cookware placed on the respective coil group is obtained.

According to preferred embodiments, the master power unit is coupled with one or more slave power units via a communication bus and the master power unit exchanges information with said one or more slave power units using said communication bus in order to operate the induction hob according to the coils activation schedule. The coils activation schedule may define an activation period which comprises multiple activation steps. During said activation steps, induction coils are activated according to operational parameters provided by the master power unit. Between subsequent activation steps, a synchronization loop may be performed in order to provide operational parameters to the slave power units based on which the slave power units operate their induction coils in the next activation step. For example the synchronization loop may be repeated with a period of 1.5 sec to 2.0 sec, specifically, 1.8 sec. By using the master-slave power unit concept, the coils activation schedule is controlled by the master power unit and no further control unit is necessary for performing the control method.

According to preferred embodiments, information for operating the induction hob is exchanged via a communication bus which is also used for coupling the master power unit and the one or more slave power units with the user interface. Thereby, the technical setup of the induction hob is significantly reduced.

According to preferred embodiments, at the beginning of the coils activation schedule, the master power unit initiates an activation message which causes the induction coils of the one or more coil group to be activated at maximum power. Based on said activation at maximum power, the slave power units are able to gather operational information which can be forwarded to the master power unit in order to define operational parameters to be used within the coils activation sequence.

According to preferred embodiments, the one or more slave power units gather operational information during operating the induction coils at maximum power and transmit a slave message including operational information to the master power unit. Within said slave message, for example, information regarding the power and frequency of the active coil, error presence information, pot detection information and temperature regulation parameters can be transmitted.

According to preferred embodiments, the master power unit establishes a target frequency value or target coil parameter value based on the received operational information. Said target frequency or target coil parameter value may be chosen such that all coil groups can be operated in a frequency band or range around said target frequency or target coil parameter. Thus, the target frequency or target coil parameter is defined for all coil groups and used by the power units for operating the induction coils associated with said coil groups.

According to preferred embodiments, the master power unit or each power unit itself defines one or more frequency ranges or coil parameter ranges based on the target frequency value or target coil parameter value. The power units are configured to use said frequency ranges or coil parameter ranges for powering their induction coils. For example, a first frequency range may be created around the target frequency value in which the induction coils are driven in normal operation. In addition, a further frequency range may be created which is arranged above the first frequency range and spaced to said first frequency range. A frequency value within said further frequency range may be used for driving one or more induction coils at a lower power level. However, only frequencies within said defined frequency ranges are allowed to be used by the power units.

According to preferred embodiments, the power unit chooses a certain frequency value or coil parameter value included in the frequency ranges or coil parameter ranges in order to provide an AC current comprising said frequency value to one or more induction coils operated by said power unit or in order to operate one or more induction coils associated with said power unit according to said coil parameter value. In other words, there is a variability in choosing AC current frequency or another coil parameter of a coil group in order to, for example, compensate deviations of the inductive coupling between the induction coil and the piece of cookware placed above said induction coil. According to an embodiment, each power unit can choose a certain frequency value or coil parameter value in the defined frequency ranges or coil parameter ranges for operating the induction coils associated with certain coil groups. However, according to other embodiments, the master power unit may assign certain frequency values or coil parameter values to the slave power units in order to operate the induction coils at said assigned frequency, respectively, at said assigned coil parameter value.

According to preferred embodiments, the coils activation schedule comprises an activation period including multiple activation steps, wherein before each activate step, control information (for example, using a synchronization loop) is provided from the master power unit to the slave power units in order to operate the induction coils coupled with the respective slave power units in the subsequent activation step according to said control information. According to other embodiments, control information is only transmitted in greater intervals, e.g. after two or more performed activation steps.

According to preferred embodiments, the calculated coil activation number comprises an integer part and a fractional part, said integer part indicating a number of constantly activated induction coils of the respective coil group and the fractional part is indicative for the amount of time in which one additional induction coil has to be activated. So, by calculating the coil activation number and switching induction coils according to said coil activation number on/off, it is possible to vary heating power provided to the piece of cookware which leads to improved acoustic noise reduction compared to changing heating power based on frequency variations.

According to preferred embodiments, in case that the coil group comprises multiple induction coils and only a fraction of said multiple induction coils has to be activated in order to provide a certain heating power to the piece of cookware associated with the coil group, the activated induction coils change in subsequent activation steps of the coils activation sequence.

Thereby, a spatial distribution of heat transfer to the piece of cookware is obtained which leads to an improved heat distribution within the piece of cookware.

According to preferred embodiments, a certain coil group is divided in multiple coil subgroups if the induction coils included in the coil group are associated with different power units. Thereby, the flexibility of operating the induction coils within the induction hob independently, specifically, in order to avoid power fluctuations and flicker due to variation of number of active induction coils within a certain power unit is significantly enhanced.

According to preferred embodiments, based on the fractional part of the calculated number of induction coils, the master power unit chooses the number of induction coils to be activated in a certain activation step such that the number of active induction coils in the induction hob, specifically the number of active induction coils associated with a certain power unit and/or the number of active induction coils associated with a certain piece of cookware is balanced or essentially balanced within an activation period. Thereby, flicker caused by power fluctuations due to a time-varying number of active induction coils within a certain power unit is significantly reduced.

According to preferred embodiments, said balancing of active induction coils is obtained by activating additional induction coils which are associated with the fractional part of the calculated coil activation number in different portions of the activation period. So, in other words, in a first coil subgroup, the highest number of induction coils may be active at the beginning of the activation period whereas in a second coil subgroup associated with the same power unit as the first coil subgroup, the highest number of induction coils may be active at the end of the activation period.

According to embodiments, the master-slave configuration of the power units may be a fixed configuration, i.e. the assignment of one power unit as master power unit and the assignment of at least one further power unit as slave power unit does not change over time.

According to other embodiments, the master-slave configuration may change over time. Specifically, the assignment of one power unit as master power unit may change over time, i.e. in regular or irregular time periods the power unit which forms the master power unit changes. For example, a certain power unit may be defined as master power unit for a single activation period or synchronization loop, respectively, multiple activation periods or synchronization loops and after said one or more activation periods or synchronization loops, the master-slave configuration is changed, i.e. another power unit is defined as master power unit. For example, the power unit powering the induction coil with the lowest frequency may be assigned as master power unit.

According to a further aspect, the invention relates to an induction hob. The induction hob comprises a plurality of induction coils and two or more power units, each power unit being coupled with one or more induction coils. The induction hob is adapted to form a cooking zone by associating one or more induction coils to a coil group. The induction hob is further adapted to:

- define one or more coil groups, each coil group being associated with one or more induction coils;
- calculate a relative power value of each coil group based on a maximum power value, the maximum power value being the power value of the coil group with the highest power request;
- calculate, for each coil group, a coil activation number based on the relative power value, the coil activation number being the number of induction coils to be activated in subsequent steps of a coils activation sequence;

establish a coils activation schedule based on the coil activation number; and operate the induction hob according to the coils activation schedule.

In addition, the induction hob is adapted to operate the power units according to a master-slave configuration, wherein a master power unit is adapted to calculate the coil activation number, establish the coils activation schedule and operate the plurality of induction coils of the master power unit and one or more slave power units according to the coils activation schedule.

The term "electrical parameter value" according to the present invention may refer to a value any electrical parameter, which is directly or unambiguously related to the electrical power.

The term "coil parameter value" as used herein preferably refers to any operational parameter to be assigned to the respective induction coil. More preferably, the term "coil parameter value" as used herein refers to any parameter that is correlated to the AC current provided through the induction coil.

For example, the electrical parameter may be the electric current provided to the respective induction coil. Additionally or alternatively, the electrical parameter may be selected from the group comprising the coil frequency, coil current, peak current, phase delay and power.

The term "essentially" or "approximately" as used in the invention means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which:

FIG. 7 shows a diagram illustrating an example coils activation schedule.

DETAILED DESCRIPTION OF PREFERRED EMBODIMENTS

Figure 1:
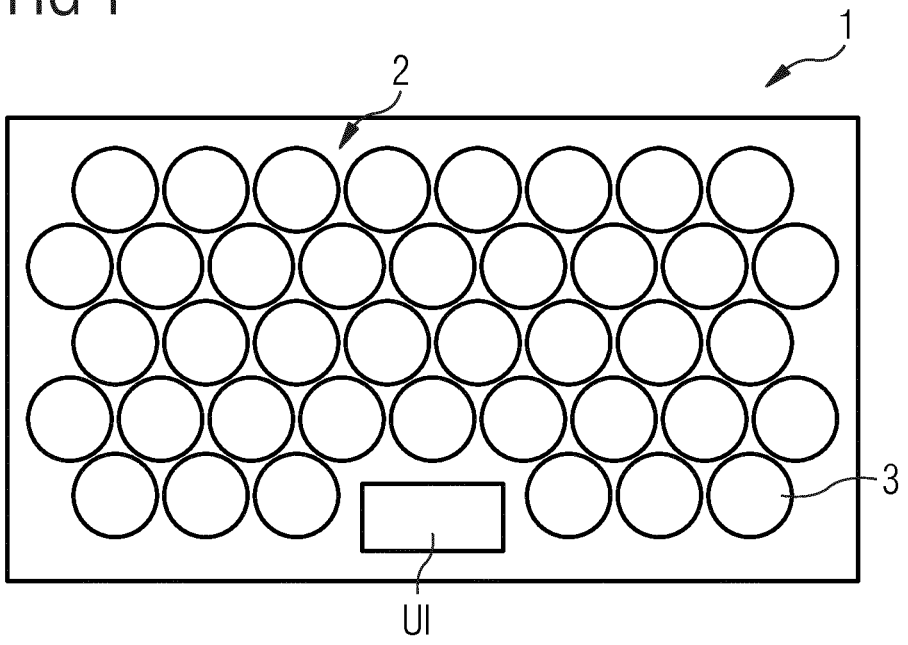
FIG. 1 shows a schematic view of an induction hob comprising an array of induction coils for realizing a flexible heating zone concept.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 shows a schematic illustration of an induction hob 1. The induction hob 1 comprises multiple induction coils 3 provided at a hob plate 2. The induction hob 1 may further comprise a user interface UI for receiving user input and/or providing information, specifically graphical information to the user.

Figure 2:
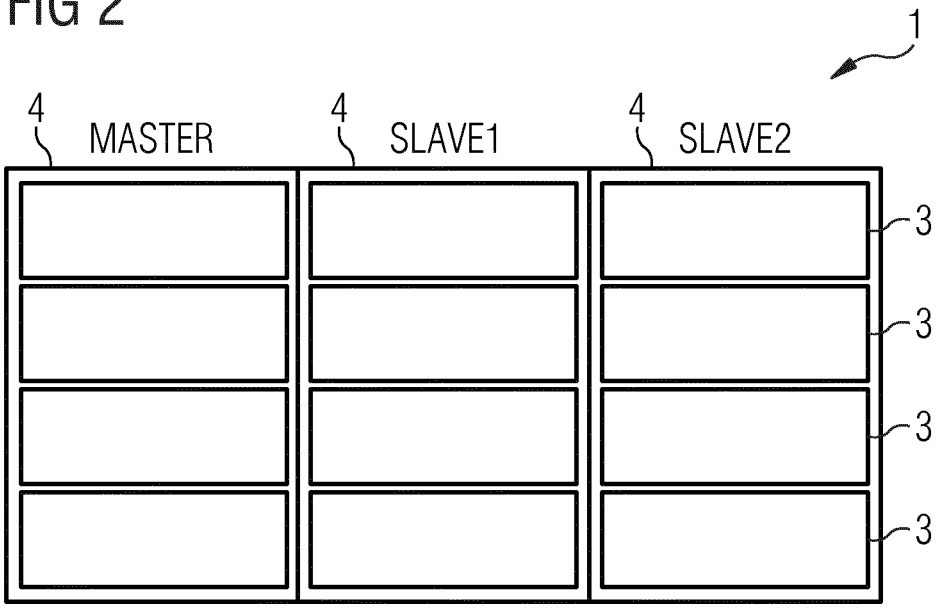
FIG. 2 shows a schematic view of an induction hob comprising multiple power units including a plurality of induction coils.

FIG. 2 shows an induction hob 1 comprising multiple power units 4. Each power unit 4 may be coupled with one or more induction coils 3. Each power unit 4 comprises power electronics for providing AC current to the induction coils 3 associated with the respective power unit 4. The induction hob 1 may implement a master-slave concept. More in detail, the power units 4 may interact with each other according to a master-slave concept. One power unit 4 may be configured as master power unit and the further power units 4 may be configured as slave power units. The power units may be coupled by a communication bus in order to exchange information. Said communication bus may be also used for coupling the power units 4 with the user interface UI. As already mentioned before, the master-slave-configuration of power units may be fixed or may change over time.

Figure 3:
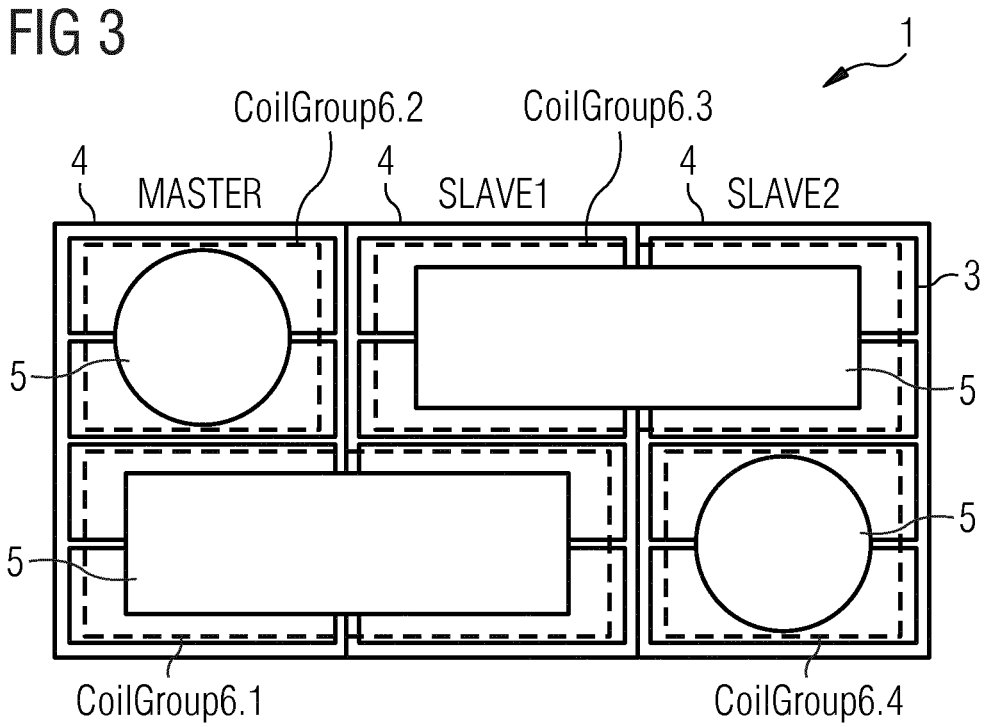
FIG. 3 shows the induction hob of FIG. 2 with multiple pieces of cookware placed on the induction hob.

FIG. 3 shows the induction hob 1 according to FIG. 2 with pieces of cookware 5 (indicated by circles and rectangles) placed on the hob plate 2. In order to form heating zones which are adapted to the base area of the respective piece of cookware placed on the hob plate 2, the induction hob 1 implements a flexible heating zone concept. Using said flexible heating zone concept, the induction hob is configured to form heating zones by grouping two or more induction coils 3. In other words, coil groups 6.1-6.4 can be build, said coil groups 6.1-6.4 comprising multiple induction coils 3. Said coil groups 6.1-6.4 are indicated in FIG. 3 by means of dashed lines. The coil groups 6.1-6.4 may be formed within a single power unit 4 (e.g. coil groups 6.2, 6.4 of FIG. 3) or may span over multiple power units 4 (e.g. coil groups 6.1, 6.3 of FIG. 3).

Figure 4:
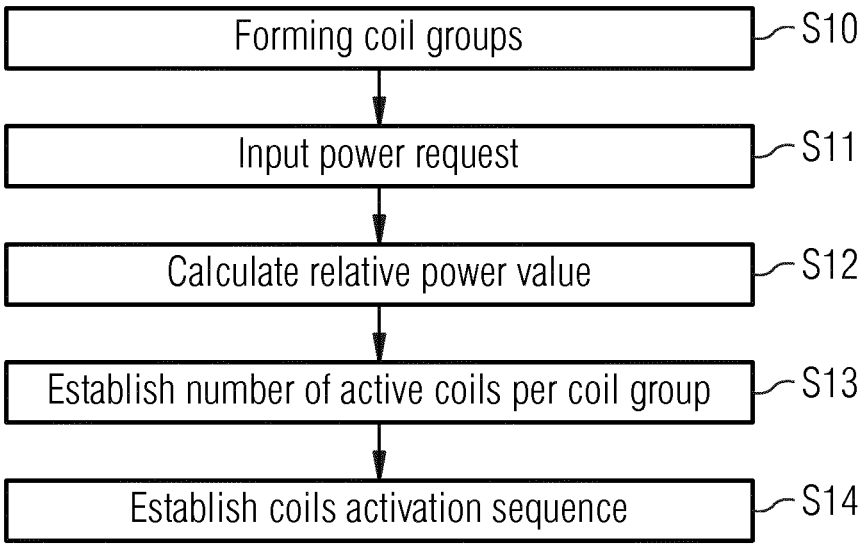
FIG. 4 shows a schematic flowchart of a method for controlling the induction hob.

In order to reduce acoustic noise generated by operating the induction hob 1, a coils activation schedule is established. After establishing the coils activation schedule, the induction hob is operated according to said coils activation schedule in order to reduce acoustic noise. The development of the coils activation schedule is described in the following in closer detail based on the flowchart of FIG. 4.

As a first step, coil groups are formed (S10). Said coil groups may be formed manually by user input at the user interface UI or may be formed automatically by a coil group formation routine executed by the induction hob 1. In addition, the user may provide information regarding a power request associated with the respective coil group (S11). In other words, the user may input at the user interface a certain power level for heating the piece of cookware placed on the coil group.

The master power unit may receive information regarding the coil groups and regarding the power request associated with the respective coil group. Based on the received information, the power unit may select the coil group with the highest power request and may calculate for each coil group a relative power value (S12), said power value indicating the relation of the power value of a certain coil group to the highest power request.

For example, the relative power value may be calculated as follows:

$$PowerPct = \left(\frac{CoilGroupPowerRequest}{HighestPowerRequest}\right) \cdot 100; \quad \text{(Formula 1)}$$

wherein

PowerPct is the relative power value;

CoilGroupPowerRequest is the power request of the respective coil group; and

HighestPowerRequest is the highest power request of all coil groups.

Based on the relative power value, the master power unit is able to determine the number of induction coils of each coil group to be activated in the activation steps of an activation period (S13). More in detail, the induction hob 1 may perform a time-discrete activation of the induction coils by defining an activation period which is iterated during the operation of the induction hob 1. The activation period is segmented in multiple activation steps wherein in each activation step a certain subset of induction coils is activated. Thereby it is possible to control the heating power provided to the respective piece of cookware by a time-selective powering of the induction coils.

The master power unit may establish the number of active induction coils in each activation step for each coil group based on the following formula:

$$\text{GroupStepCoils}=(\text{PowerPct}-\text{GroupCoilNr})/100; \qquad \text{(Formula 2)}$$

wherein

GroupStepCoils is the number of active induction coils per coil group in an activation step;

PowerPct is the relative power value; and

GroupCoilNr is the number of induction coils included in a certain coil group.

The value of "GroupStepCoils" may be a float comprising an integer part (value at the pre-decimal position) and a fractional part (value at the post-decimal position). The integer part is indicative for the number of induction coils being active in each activation step. The fractional part is indicative for the number of activation steps in which an additional induction coil has to be activated. According to an example, the value of "GroupStepCoils" is 1.5. Thus, considering an activation period including ten activation steps, in five activation steps two induction coils are powered and in the remaining five activation steps, only one induction coil of the coil group is activated. In order to avoid only a spatially limited heating of the piece of cookware, a spatial variation of activated induction coils is implemented (in the following also referred to as coil rotation). So, in other words, in case that not all induction coils are activated over the whole activation period, the active induction coils are varied by an appropriate coils activation sequence.

According to embodiments, coil groups which span over multiple power units (e.g. coil groups 6.1 and 6.3 according to FIG. 3) will be segmented in two or more coil group segments wherein each coil group segment is associated with a single power unit. For example, the coil group 6.3 extends over the power units "slave1" and "slave1" and will therefore be divided in two coil group segments, namely a first coil group segment powered by power unit "slave1" and a second coil group segment powered by power unit "slave2". Thereby it is possible to increase the spatial variation of heat transfer to a piece of cookware and to improve the heat distribution within the piece of cookware.

Finally, the master power unit is configured to establish a coils activation sequence (S14). Based on the coils activation sequence the master power unit is able to control the activation of induction coils 3 associated with a certain coil group or a certain coil subgroup. More in detail, based on the coils activation sequence, the master power unit is able to define the time-dependent activation of certain induction coils, the target power of said induction coils and the frequency of the AC current provided to the induction coils. According to preferred embodiments, the active coils may be activated with the same target power. The power regulation may be achieved by a time-dependent "switching on"-"switching off" of the induction coils.

The master power unit may be configured to define certain operation parameter based on a synchronization loop before starting the coils activation sequence. First, the master power unit may activate the induction coils of the coil groups at maximum power, i.e. at the highest power request of all coil groups. As a response, the master power unit may receive from the slave power units operational information gathered during the activation of the coils at maximum power. For example, said operational information may include information regarding the power and frequency of the active coils, information regarding an occurred error, pot detection status information and/or temperature regulation parameters. It is worth mentioning that additional information or less information can be provided to the master power unit during the synchronization loop.

Based on the information derived within the synchronization loop before starting the coils activation sequence, the master power unit is adapted to determine a target frequency value. Based on the target frequency value, the master power unit is able to determine one or more frequency bands, which can be used as AC current frequencies by the power units 4.

Figure 5:
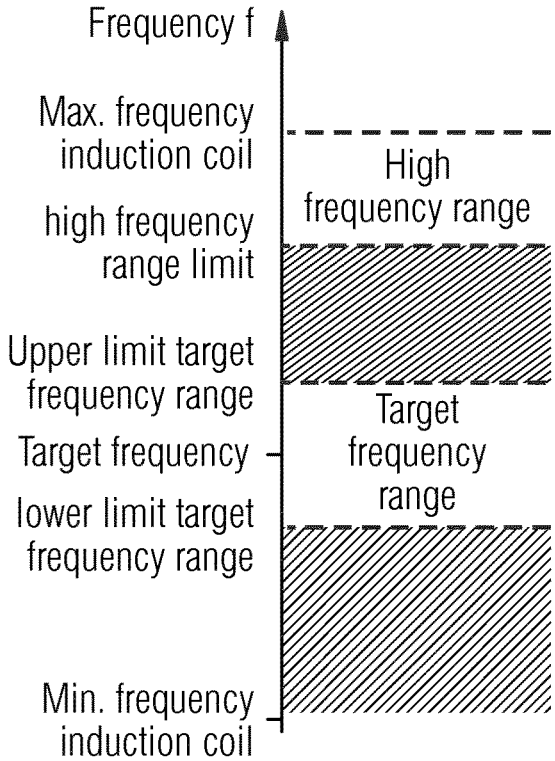
FIG. 5 shows a frequency map including two frequency ranges to be used for operating the induction coils of the induction hob.

FIG. 5 shows a frequency diagram including two allowed frequency ranges, wherein only frequencies within said allowed frequency ranges can be used as AC current frequencies. More specifically, a target frequency range comprising an upper limit and a lower limit is created around the target frequency value. In addition, a high frequency range is created at the upper boundary of the frequency band allowed for the respective induction coils. Said high frequency range is defined at the lower boundary by a high frequency range limit value and at the upper boundary by the maximum frequency value allowed for the respective induction coil. The values defining the target frequency range and the high frequency range are chosen according to the target frequency value established by the master power unit using information derived within the synchronization loop. More in detail, the ranges are chosen such that no or essentially no acoustic noise occurs when the frequency of the active induction coils is chosen within the defined limits.

The master power unit is adapted to provide the target frequency value, preferably parameter defining the allowed frequency ranges (cf. FIG. 5) to the slave power units. According to other embodiments, the master power unit only provides the target frequency value and each power unit determines the frequency ranges on their own. The slave power units as well as the master power unit can choose the AC current frequency out of the allowed frequency ranges. So, during normal operation, the power units may choose AC current frequency values within the target frequency range. Different induction coils may be driven at different AC current frequency values in order to increase the power in case of bad coupling between the induction coil and the piece of cookware. So in other words, AC current frequency of the induction coils can be spread within the target frequency range. Even more, for example, in order to enable a fast power reduction, the induction coils may be driven at AC current frequencies in the high frequency range. So, in case of such fast power reduction, the AC current frequency jumps from the target frequency range over a forbidden frequency range to a frequency value included in the high frequency range.

Figure 6:
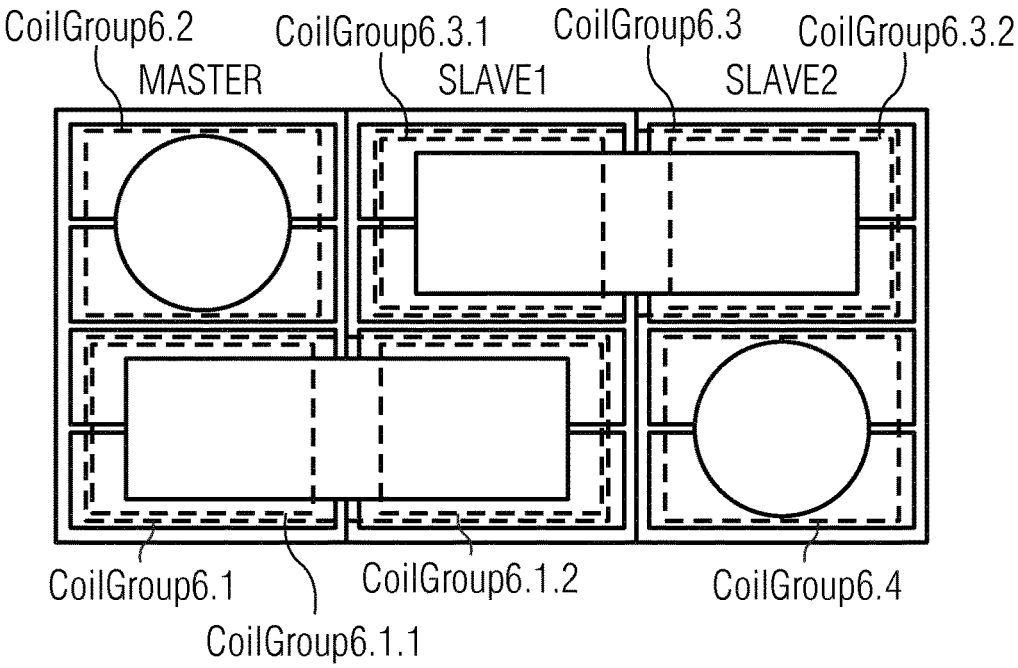
FIG. 6 shows the induction hob with multiple pieces of cookware placed on the induction hob and coil groups and coil subgroups built according to said pieces of cookware.

In the following, the method for reducing acoustic noise using a coils activation schedule is further described based on the example shown in FIG. 6. The basic configuration of the induction hob 1 and its coverage by pieces of cookware is identical to the configuration shown in FIG. 3. At the beginning, the coil groups and the power requests for each coil group are received. The following table shows the coil groups together with their power request and the number of induction coils associated with said coil groups.

TABLE 1

| Coil group | Power request | Number of induction coils |
|---|---|---|
| 6.1 | 900 W | 4 |
| 6.2 | 400 W | 2 |
| 6.3 | 600 W | 4 |
| 6.4 | 200 W | 2 |

As shown in table 1, coil groups 6.1 and 6.3 span over different power units 4. Therefore, coil group 6.1 is segmented in two subgroups (CoilSubGroup 6.1.1 and CoilSubGroup 6.1.2) and coil group 6.3 is segmented in two subgroups (CoilSubGroup 6.3.1 and CoilSubGroup 6.3.2). Table 2 shows the modified association of power requests and number of induction coils to the respective coil groups.

TABLE 2

| Coil (sub-)group | Power request | Number of induction coils |
|---|---|---|
| 6.1.1 | 900 W | 2 |
| 6.1.2 | 900 W | 2 |
| 6.2 | 400 W | 2 |
| 6.3.1 | 600 W | 2 |
| 6.3.2 | 600 W | 2 |
| 6.4 | 200 W | 2 |

Based on the maximum power request (900 W), the relative power value (PowerPct, Formula 1) is the calculated.

TABLE 3

| Coil (sub-)group | Power request | relative power value |
|---|---|---|
| 6.1.1 | 900 W | 100% |
| 6.1.2 | 900 W | 100% |
| 6.2 | 400 W | 44% |
| 6.3.1 | 600 W | 66% |
| 6.3.2 | 600 W | 66% |
| 6.4 | 200 W | 22% |

Based on the relative power value, the number of active induction coils per coil group in an activation step (GroupStepCoils, Formula 2) is calculated.

TABLE 4

| Coil (sub-) group | Power request | Nr. induction coils | Group-Step-Coils | Integer part | Fractional part |
|---|---|---|---|---|---|
| 6.1.1 | 900 W | 2 | 2 | 2 | 0 |
| 6.1.2 | 900 W | 2 | 2 | 2 | 0 |
| 6.2 | 400 W | 2 | 0.8 | 0 | 8 |
| 6.3.1 | 600 W | 2 | 1.3 | 1 | 3 |
| 6.3.2 | 600 W | 2 | 1.3 | 1 | 3 |
| 6.4 | 200 W | 2 | 0.4 | 0 | 4 |

So, according to table 4, in CoilSubGroups 6.1.1 and 6.1.2 all induction coils are active in all activation steps. In coil group 6.2, in eight of ten activation steps (ten activation steps may refer to one activation period) one induction coil is active. In CoilSubGroups 6.3.1 and 6.3.2, one induction coil is active in all activation steps and an additional induction coil is active in three of ten activation steps. Finally, in coil group 6.4, in four of ten activation steps one induction coil is active.

To keep the power consumption as constant as possible for each power board and thus avoid flicker, the activation sequence of induction coils is adjusted. For example, the activation sequence of induction coils being associated with the same power unit is varied in order to obtain a balanced load of the respective power unit. More in detail, the activation sequence may start with the highest number of active coils in the first activation steps of the activation period. In case that a coil group is divided in two or more subgroups, especially in case that two or more subgroups are associated with the same power unit, the activation sequence of a first subgroup starts with the highest number of active coils in the first activation steps of the activation period (in the following referred to as "power falling"). In contrary thereto, a further subgroup associated with the same power unit is driven with an activation sequence in which the highest number of induction coils is activated in the last activation steps of the activation period (in the following referred to as "power rising"). So, in other words, the number of induction coils activated in a certain power unit is balanced by choosing the highest number of active induction coils of a first coil subgroup and the lowest number of active induction coils of a second coil subgroup in the same activation steps.

In order to identify which coil subgroups should have opposite activation sequences, corresponding coil (sub-) groups are linked.

Table 5 shows the activation sequence mode of the respective coil subgroups.

TABLE 5

| Coil (sub-)group | activation sequence mode |
|---|---|
| 6.1.1 | Power falling |
| 6.1.2 | Power rising |
| 6.2 | Power rising |
| 6.3.1 | Power falling |
| 6.3.2 | Power rising |
| 6.4 | Power falling |

In order to obtain a balanced power consumption of each power unit, the coil subgroup 6.1.1 is driven according to "power falling" activation sequence mode, i.e. coil subgroup 6.1.1 starts with the highest number of active coils in the first activation steps of the activation period. Coil group 6.2 is linked to coil subgroup 6.1.1 because both are associated with the same power unit. Thus, coil subgroup 6.1.2 should be activated according to an opposite activation behaviour, i.e. "power rising" activation sequence mode.

Coil subgroup 6.1.2 is linked to coil subgroup 6.1.1 because both are associated with the same piece of cookware. Thus, coil subgroup 6.1.2 should be activated according to an opposite activation behaviour, i.e. "power rising" activation sequence mode.

Coil subgroup 6.3.1 is linked to coil subgroup 6.1.2 because both are associated with the same power unit. Therefore, coil subgroup 6.3.1 should be activated according to an opposite activation behaviour than coil subgroup 6.1.2, i.e. "power falling" activation sequence mode.

Coil subgroup 6.3.2 is linked to coil subgroup 6.3.1 because both are associated with the same piece of cookware. Therefore, coil subgroup 6.3.2 should be activated according to an opposite activation behaviour than coil subgroup 6.3.1, i.e. "power rising" activation sequence mode.

Finally, coil subgroup 6.4 is linked to coil subgroup 6.3.2 because both are associated with the same power unit. Therefore, coil subgroup 6.4 should be activated according to an opposite activation behaviour than coil subgroup 6.3.2, i.e. "power falling" activation sequence mode.

FIG. 7 shows a diagram illustrating the coils activation schedule. The activation period is segmented in ten activation steps. The activation periods are iterated until the induction hob is switched off, the power requests of one or more coil groups are changed or the configuration of coil groups changes. According to embodiments, between two subsequent activation steps, specifically between each pair of subsequent activation steps a synchronization loop is performed in order to exchange control information between the master power unit and the one or more slave power units. The crosshatched fields indicate the first activation step within the activation sequence. The dotted fields indicate the activated coils in the respective activation steps. The sign "X" indicates the coil group coil index which is modified each activation step. Thereby, a rotation or variation of the active coil in the respective coil group, respectively, coil subgroup is obtained which improves the heat distribution in the piece of cookware.

As can be seen in FIG. 7, coil subgroup 6.3.1 and 6.3.2 show opposite activation behaviour (coil subgroup 6.3.1 shows "power falling" behaviour and coil subgroup 6.3.2 shows "power rising" behaviour) in order to homogenize the heat transfer to the piece of cookware associated with said coil subgroups 6.3.1 and 6.3.2. Similarly, coil subgroup 6.3.2 and coil group 6.4 also show opposite activation behaviour in order to obtain an equal or essentially equal load of the power unit powering the coil subgroup 6.3.2 and the coil group 6.4.

It should be noted that the description and drawings merely illustrate the principles of the proposed methods and devices.

Those skilled in the art will be able to implement various arrangements that, although not explicitly described or shown herein, embody the principles of the invention.

LIST OF REFERENCE NUMERALS

1 induction hob
2 hob plate
3 induction coil
4 power unit
5 pieces of cookware
6.1-6.4 coil group
6.1.1 coil subgroup
6.1.2 coil subgroup
6.3.1 coil subgroup
6.3.2 coil subgroup
UI user interface

The invention claimed is:

1. A method for controlling an induction hob, the induction hob comprising induction coils, wherein the induction hob includes a master power control unit being coupled with one or more slave power control units via a communication bus in order to operate the induction coils, wherein an information for operating the induction hob is exchanged between the master power control unit and the one or more slave power control units, and a cooking zone is formed by associating one or more of said induction coils to a coil group, the method for controlling the induction bob by using a master-slave power unit concept comprising the steps of:

defining a plurality of coil groups by the master power control unit, wherein at least one coil group comprises a plurality of sub coil groups including a first sub coil group and a second sub coil group, each sub coil group being associated with at least two induction coils;

receiving power requests from an user interface, each power request associated with a respective coil group;

calculating respective power values for each said coil group and respective sub power values for each sub coil group by the master power control unit, based on the received power requests;

calculating by the master power control unit, for each said coil group, coil activation numbers based on the respective power values, and for each said sub coil group, sub coil activation numbers based on the respective sub power values, the coil activation number and the sub coil activation number being the number of induction coils to be activated in subsequent steps of a coils activation sequence, wherein the master power control unit provides operational parameters to the one or more slave power units based on which the one or more slave power units operate their induction coils in a next activation step;

establishing a coils activation schedule table for scheduling the coil activation numbers of induction coils for each said coil group and the sub coil activation numbers of induction coils for each said sub coil group by the master power control unit, wherein the coils activation schedule table includes a plurality of time periods in a first axis of the coils activation schedule table and indications for activation or non-activation of each of the plurality of said induction coils in a second axis of the coils activation schedule table, in which each of the plurality of said induction coils is scheduled to be activated or not to be activated over each of the plurality of time periods, wherein induction coils of the first sub coil group are scheduled to change from a lower number of activated coils to a higher number of activated coils for power rising when induction coils of the second sub coil group are scheduled to change from a higher number of activated coils to a lower number of activated coils for power falling;

operating each of the plurality of said induction coils of the induction hob according to the coils activation schedule table and the selected AC frequencies.

2. The method according to claim 1, wherein the master power control unit calculates the coil activation number based on a respective power request, establishes the coils activation schedule table based on the coil activation number, and operates the plurality of induction coils of the master power control unit and one or more slave power control units according to the coils activation schedule table, wherein the master power control unit is coupled with said one or more slave power control units and the master power control unit exchanges information with said one or more slave power control units in order to operate the induction hob according to the coils activation schedule table.

3. The method according to claim 2, wherein information for operating the induction hob is exchanged for coupling the master power control unit and the one or more slave power control units with a user interface.

4. The method according to claim 2, wherein at the beginning of the coils activation schedule table, the master power control unit initiates an activation message which causes the induction coils of the one or more coil groups to be activated at a maximum power.

5. The method according to claim 4, wherein the one or more slave power control units provide at least one of information on a power and frequency of the active coils, information on an occurred error, pot detection status information or temperature regulation parameters to the master power control unit.

6. The method according to claim 5, wherein the master power control unit establishes a target frequency value or target coil parameter value based on the received operational information.

7. The method according to claim 6, wherein the master power control unit defines one or more frequency ranges or coil parameter ranges based on the target frequency value or target coil parameter value.

8. The method according to claim 7, wherein a certain frequency value or coil parameter value is chosen within the frequency ranges or coil parameter ranges in order to provide an AC current comprising said frequency value to one or more of said induction coils.

9. The method according to claim 2, wherein the coils activation schedule table comprises an activation period including multiple activation steps, wherein before each said activate step, control information is provided from the master power control unit to the one or more slave power control units in order to operate the induction coils coupled with the respective one or more slave power control units in the subsequent activation step according to said control information.

10. The method according to claim 1, wherein the calculated coil activation number comprises an integer part and a fractional part, said integer part indicating a number of constantly activated induction coils of the respective coil group and the fractional part is indicative of the amount of time in which one additional induction coil has to be activated.

11. The method according to claim 1, wherein in case that a said coil group comprises multiple induction coils and only a fraction of said multiple induction coils has to be activated in order to provide a certain heating power to a piece of cookware associated with the coil group, the activated induction coils of said coil group change in subsequent activation steps of the coils activation sequence.

12. The method according to claim 10, wherein, based on the fractional part of the calculated number of induction coils, the master power control unit chooses the number of induction coils to be activated in a certain activation step such that at least one of the number of active induction coils associated with a certain power unit, or the number of active induction coils associated with a certain piece of cookware, is balanced within an activation period.

* * * * *